US006517447B2

(12) United States Patent
Buchanan

(10) Patent No.: US 6,517,447 B2
(45) Date of Patent: Feb. 11, 2003

(54) GOLF CLUB AND CONNECTION THEREFOR

(76) Inventor: Douglas Boyd Buchanan, 43 Lower Broad St., Ludlow, Shropshire SY8 1PH (GB)

( * ) Notice: Subject to any disclaimer, the term of this patent is extended or adjusted under 35 U.S.C. 154(b) by 0 days.

(21) Appl. No.: 09/333,950

(22) Filed: Jun. 16, 1999

(65) Prior Publication Data

US 2002/0019264 A1 Feb. 14, 2002

(51) Int. Cl.[7] ..... A63B 53/00; A63B 55/00

(52) U.S. Cl. ..... 473/282; 473/340; 473/305

(58) Field of Search ..... 473/324, 305, 473/306, 307, 308, 309, 310–315, 332, 342, 330, 331, 251; D21/738

(56) References Cited

U.S. PATENT DOCUMENTS

| | | | | |
|---|---|---|---|---|
| 3,206,206 A | | 9/1965 | Santosuosso | |
| 3,387,844 A | | 6/1968 | Shippee | |
| 3,873,094 A | | 3/1975 | Sebo et al. | |
| 4,324,404 A | | 4/1982 | Dian | |
| 4,411,430 A | * | 10/1983 | Dian | 273/171 |
| 4,988,104 A | * | 1/1991 | Shiotani | 273/167 H |
| 5,090,698 A | * | 2/1992 | Kleinfelter | 273/80.2 |
| 5,127,653 A | * | 7/1992 | Nelson | 273/164 |
| 5,193,806 A | * | 3/1993 | Burkly | 273/80.2 |
| 5,257,807 A | * | 11/1993 | Baumann et al. | 273/80 |
| 5,342,052 A | | 8/1994 | Costa | |
| D368,292 S | * | 3/1996 | Willoughby | D21/218 |
| 5,632,694 A | | 5/1997 | Lee | |
| 5,746,664 A | * | 5/1998 | Reynolds, Jr. | 473/252 |
| 5,855,525 A | * | 1/1999 | Turner | 473/300 |
| 6,066,053 A | * | 5/2000 | Sehemberger | 473/230 |
| 6,348,014 B1 | * | 2/2002 | Chiu | 473/337 |

* cited by examiner

*Primary Examiner*—Paul T. Sewell
*Assistant Examiner*—Sneh Varma
(74) *Attorney, Agent, or Firm*—Liniak, Berenato & White

(57) ABSTRACT

A golf putter is provided. The golf putter includes a head having a cavity. An insert member is supported within the cavity by Neoprene resilient O-rings and a shaft or hosel member is connected to the insert. Because the insert member is insulated from the head by the resilient O-rings, less impact energy is dissipated within the head. The insert member is arranged to be at the sweet spot of the head.

30 Claims, 1 Drawing Sheet

GOLF CLUB AND CONNECTION THEREFOR

This invention relates to a golf club. More particularly the invention is concerned with the provision of a novel connection between the head of a golf club and the shaft. In prior art golf clubs as shown in FIG. 1 a golf club 1 comprises a head 2 connected to a shaft 3. The head 2 has a striking face 4 with a so called sweet-spot 5 which is usually arranged to occur at the geometrical centre of area of the striking face 4 as indicated by the crossed lines. Ideally impact with a golf ball is sought to take place at the sweet-spot 5. A problem with this prior art arrangement is that the shaft 3 is displaced somewhat from the impact area and is fixed directly to the head 2. As a consequence of this some of the energy of impact is dissipated within the head thus lessening the amount of impact energy which can be transmitted up the shaft to the player's hands so that in one sense the amount of energy available to define "feel" is reduced.

According to the present invention there is provided a golf club having a head including a striking face with a sweet-spot, the head comprising an outer shell member defining a cavity, an insert located within the cavity spaced from the outer shell member and a shaft connection fixed to the insert through the outer shell.

The present invention will now be described by way of example only and with reference to the accompanying drawings wherein.

Figure 1:
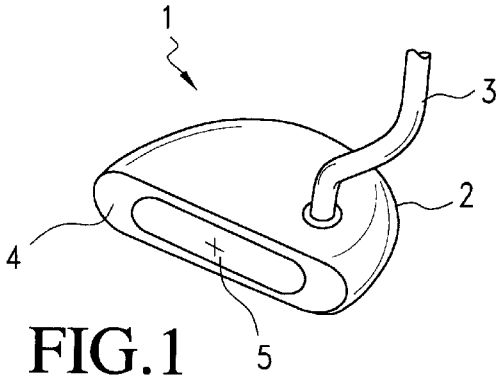
FIG.1 (Prior Art)
FIG. 1 is a prior art golf club and connection.
Figure 5:
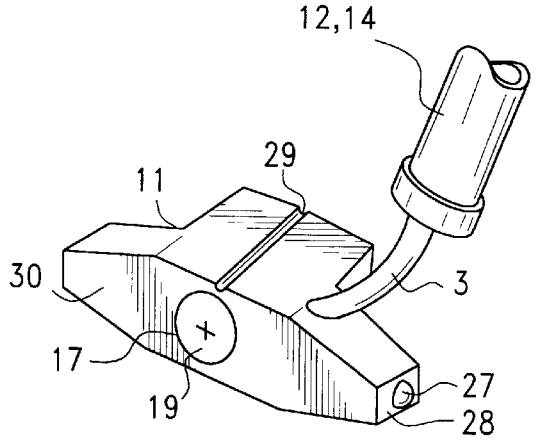
FIG. 5 is a perspective view of a putter head and shaft connection in accordance with the present invention.
Figure 2:
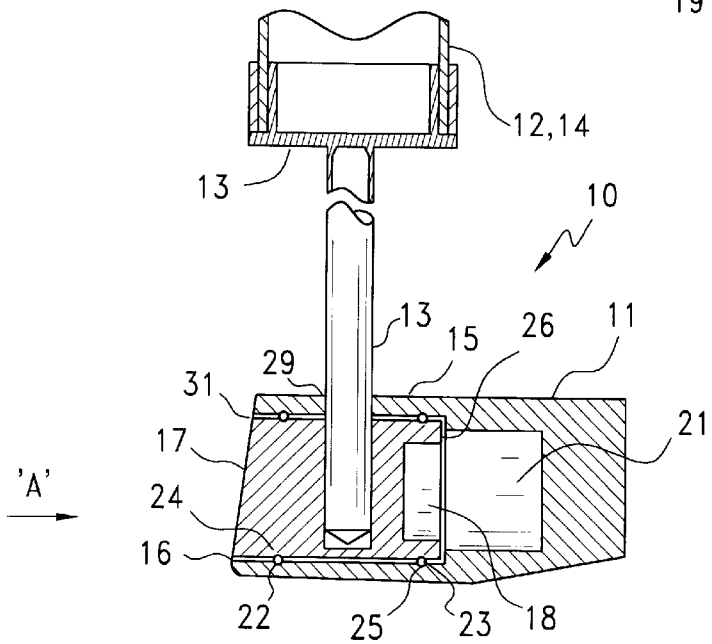
FIG. 2 is a part sectional elevation of a golf putter in accordance with the present invention.
Figure 3:
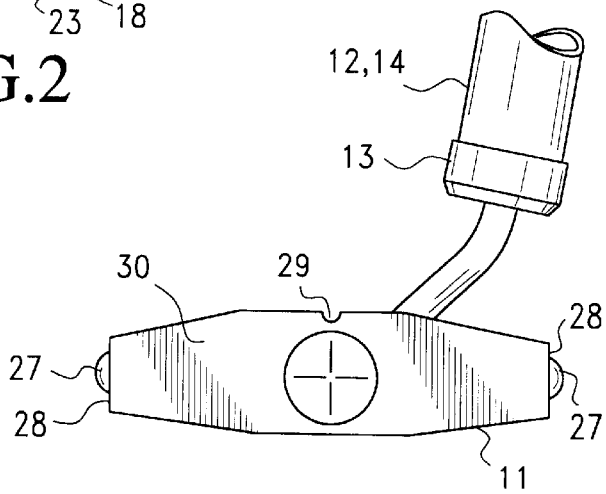
FIG. 3 is a part elevational view looking on arrow "A" of FIG. 2.
Figure 4:
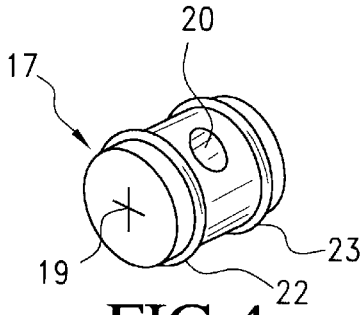
FIG. 4 is a perspective view of an insert used in the practice of the invention.

In FIG. 2 there is shown a golf putter 10 in accordance with the present invention. Golf putter 10 comprises a generally T-shaped head 11 connected to a shaft 12 by means of a hosel member 13. Head 11 includes a striking face 30 as well as non-striking faces or non-striking surfaces which are not intended to contact a ball during normal use. Hosel member 13 may be hollow. A shaft connection may comprise the hosel member 13 or the hosel member 13 may be dispensed with and the shaft connection may comprise a shaft 14 connected directly to the head 11. The head 11 comprises an outer shell member 15 which defines a cavity 16 in head 11 having an opening in the striking face 30, an inner sidewall and an end wall. Insert member 17 is generally cylindrical and includes a first end having a first end edge, a second end having a second end edge, and a sidewall extending between the end edges is made of bronze material and defines a rear cavity 18. The bronze material is selected to be a soft ductile material to facilitate the transmission of shock. A sweet spot 19 of the head 11 is arranged to be at the center of the circular face area of insert 17 as indicated by the crossed lines as best seen in FIG. 4. An aperture 20 is formed in insert 17 by drilling and reaming to receive and ensure a proper fit with either hosel 13 or shaft 14. As seen in FIG. 2 hosel member 13 stops short of the end of the aperture 20 so that it does not contact outer shell member 15. It is believed this arrangement enhances the transmission of impact energy to the putter shaft as feel. Cavity 18 in combination with the remaining part of cavity 16 defines a void 21 in head 11. Void 21 is believed to increase the resonance factor of head 11. Insert 17 is supported and fixed within cavity 16 by means of Neoprene resilient O-rings 22, 23 fitted to semi-circular grooves 24, 25 formed around the circular periphery of insert 17. A small clearance exists between insert 17 and a shoulder 26 formed within outer shell member 15. Also as best seen in FIG. 2 the O-rings 22,.23 space the insert 17 from outer shell member 15 so that a small clearance 31 is formed which in a sense insulates insert 17 from outer shell member 15. Stabilizing or inertia weights 27 are let into the sides 28 of the head 11 to minimize the effect of off-centre hits. A slot 29, see FIG. 5, assists in aiming the striking faced 30 of the putter head 11. Outer shell member 15 and hosel member 13 are made of aircraft quality high strength aluminum and when shaft 12, 14 comprises a substantially large diameter shaft the shaft will be made of carbon fibre material. In addition to resiliently fixing insert 17 within cavity 16 the O-rings act as seals to prevent dirt and moisture from entering void 21 through clearance 31. Shaft 14 or hosel member 13 enters the aperture 20 in insert 17 through a hole 29 drilled in outer shell member 15. As can be appreciated from FIG. 3 because insert 17 is insulated from a outer shell member 15 by the resilient O-rings any impact on insert 17 is transferred more or less directly to shaft 14 or hosel 13 with less impact energy being dissipated within head 11. Consequently a golf club, for example a putter as shown in FIG. 2 may have an increased "feel factor" due to the increased energy being transmitted up the shaft 12, 14. It has been found in practice that the void 21 also enhances the feel factor. The present invention may be used with so called standard shafts. However, the invention can be most advantageously used in a putter with a substantially large diameter (between 25 and 45 mm), thin walled, parallel shaft to enhance the "feel factor". The present invention may be used in golf clubs other than putters but in that case due care must be taken with the design because of the higher forces that may be involved.

What is claimed is:

1. A golf club having a head including a striking face with a sweet spot for impacting a golf ball, the head comprising an outer shell member defining a cavity, an inner insert member defining said sweet spot located within the cavity spaced from the outer shell member by a clearance space by a resilient spacer, said insert member being resiliently supported and fixed within the cavity by said resilient spacer, and a shaft fixed to the insert through the outer shell member.

2. A golf club according to claim 1 wherein the resilient spacer comprises at least one resilient O-ring.

3. A golf club according to claim 1 wherein the shaft is fixed to the insert by a hosel member.

4. A golf club according to claim 3 wherein the hosel member fits within an aperture formed in the insert and stops short of the end of the aperture so that it does not contact the outer shell member.

5. A golf club according to claim 3 wherein the hosel member is hollow.

6. A golf club according to claim 3 wherein the shaft is fitted to the hosel.

7. A golf club according to claim 6 wherein the shaft is hollow and has an outer diameter of from about 25 mm to about 45 mm.

8. A golf club according to claim 2 wherein the O-rings seal the insert within the cavity of the outer shell member.

9. A golf club according to claim 1, said golf club is a putter.

10. A golf club according to claim 1 or claim 3 wherein the outer shell member and the hosel are made of aluminum.

11. A golf club according to claim 1 wherein the insert is made of a soft ductile bronze material.

12. A golf club according to claim 2 wherein the resilient O-rings comprise the material Neoprene.

13. A golf club according to claim 2, wherein the insert is cylindrical.

14. A golf club according to claim 13, wherein the insert has a groove and the at least one O-ring is at least partially disposed inside the groove.

15. A golf club according to claim 3, wherein the hosel and outer shell member are made of aluminum and the insert is made of bronze.

16. A golf club according to claim 1, wherein inertia weights are disposed on first and second sides of said head.

17. A golf club having a head including a striking face with a sweet spot, the head comprising an outer shell member defining a cavity, an inner insert member defining said sweet spot located within the cavity spaced from the outer shell member by a clearance space by a resilient spacer, and a shaft fixed to the insert through the outer shell member, wherein the insert includes a blind rear cavity.

18. A golf club having a head including a striking face with a sweet spot, the head comprising an outer shell member defining a cavity, an inner insert member located within the cavity spaced from the outer shell member by a resilient spacer, and a shaft fixed to the insert through the outer shell member, wherein the cavity in the rear of the insert and part of the cavity in the outer shell member form a void in the head.

19. A golf club comprising:

a head having at least one non-striking surface and a striking face having a blind bore;

an insert having a wall with an opening and an end face, said insert being mounted in said blind bore such that said end face is flush with said striking face;

a first opening in said at least one non-striking surface intersecting said blind bore; and a shaft extending through said first opening into said second opening.

20. The golf club of claim 19 including at least one spacer between said insert and said blind bore.

21. The golf club of claim 20 wherein said at least one spacer is resilient.

22. The golf club of claim 21 wherein said at least one spacer comprises at least one O-ring.

23. The golf club of claim 19 wherein said blind bore has an end wall and a depth and said insert has a length less than said depth, whereby a void is formed between said insert and said end wall when said end face is flush with said striking face.

24. The golf club of claim 19 wherein said golf club includes a sweet spot located on said end face of said insert.

25. A golf club comprising:

a head having at least one non-striking surface and a striking face having a blind bore;

an insert having a wall with an insert opening and an end face, said insert being mounted in said blind bore such that said end face is substantially flush with said striking face;

a first opening in said at least one non-striking surface intersecting said blind bore; and a shaft extending through said first opening into said insert opening;

wherein said blind bore has an end wall and a depth and said insert has a length less than said depth, whereby a void is formed between said insert and said end wall when said end face is flush with said striking face, said insert including a cavity communicating with said void.

26. A golf club comprising a head including a striking face and at least one non-sticking surface, an opening in said striking face including an opening sidewall, and an insert having a first end having an end edge, a second end having an end edge and a sidewall mounted in said opening such that said insert first end edge is spaced apart from said opening sidewall, and a shaft connected to said insert and extending through an opening in said at least one non-striking surface.

27. The golf club of claim 26 wherein said insert first end is flush with said sticking surface.

28. The golf club of claim 27 wherein said insert second end edge is spaced apart from said opening sidewall.

29. The golf club of claim 26 wherein said head includes at least one O-ring between said insert sidewall and said opening sidewall.

30. The golf club of claim 28 wherein said at least one O-ring is resilient.

* * * * *

UNITED STATES PATENT AND TRADEMARK OFFICE

CERTIFICATE OF CORRECTION

PATENT NO. : 6,517,447 B2
DATED : February 11, 2003
INVENTOR(S) : Douglas Boyd Buchanan It is certified that error appears in the above-identified patent and that said Letters Patent is hereby corrected as shown below:

Column 4,
Line 28, delete “non-sticking” and insert therefor -- non-striking --.
Line 37, delete “sticking” and insert therefor -- striking --.

Signed and Sealed this

Twenty-fifth Day of January, 2005

JON W. DUDAS
*Director of the United States Patent and Trademark Office*